US007632420B2

(12) United States Patent
Thomas et al.

(10) Patent No.: US 7,632,420 B2
(45) Date of Patent: Dec. 15, 2009

(54) LASER REMOVAL OF LAYER OR COATING FROM A SUBSTRATE

(75) Inventors: Adrian Thomas, Mid Glamorgan (GB); Jonathan Davies, Mid Glamorgan (GB); Peter Hugh Dickinson, Mid Glamorgan (GB)

(73) Assignee: Spectrum Technologies PLC, Mid Glamorgan (GB)

( * ) Notice: Subject to any disclaimer, the term of this patent is extended or adjusted under 35 U.S.C. 154(b) by 500 days.

(21) Appl. No.: 10/885,648

(22) Filed: Jul. 8, 2004

(65) Prior Publication Data

US 2005/0006345 A1 Jan. 13, 2005

(30) Foreign Application Priority Data

Jul. 8, 2003 (GB) ..... 0315947.2
Jul. 12, 2003 (GB) ..... 0316347.4

(51) Int. Cl.
*B44C 1/22* (2006.01)

(52) U.S. Cl. ..... 216/65; 216/37; 134/1.1; 134/11; 134/22; 427/331; 427/334; 427/402

(58) Field of Classification Search ..... 216/37; 134/1.1; 427/331
See application file for complete search history.

(56) References Cited

U.S. PATENT DOCUMENTS 4,081,653 A 3/1978 Koo et al.
5,151,134 A 9/1992 Boquillon et al.
5,620,754 A * 4/1997 Turchan et al. ..... 427/554
6,210,514 B1 * 4/2001 Cheung et al. ..... 156/241
6,348,241 B2 * 2/2002 Ronge et al. ..... 427/554
6,468,356 B1 10/2002 Crema et al.
6,509,547 B1 1/2003 Bernstein et al.

FOREIGN PATENT DOCUMENTS

EP 0930126 7/1999
FR 2 692 822 12/1993

OTHER PUBLICATIONS

M.Bonelli, Europhysics Letters, vol. 50(4), p. 501, (2000).*
Charles Montross, International Journal of Fatigue vol. 24, (2002) 1021-1036.*
CN Office Action dated Jul. 24, 2009 from corresponding CN application 200480019423.2.

* cited by examiner

*Primary Examiner*—Nadine Norton
*Assistant Examiner*—Maki Angadi
(74) *Attorney, Agent, or Firm*—Young & Thompson

(57) ABSTRACT

A method for treating a substrate having a layer or coating of material thereon (such as for example a metal conductor coated with an insulating 'enamel') comprises the steps of directing a pulsed beam of laser radiation at the substrate to cause an interaction or adjacent the interface between the layer or coating and the substrate, leading to local separation of the layer or coating. The removal is effected by creating an interaction effect at the interface between the substrate and the layer or coating to create an effect similar to a shockwave which causes local separation of the layer or coating at the interface.

20 Claims, 1 Drawing Sheet

LASER REMOVAL OF LAYER OR COATING FROM A SUBSTRATE

Figure 1:
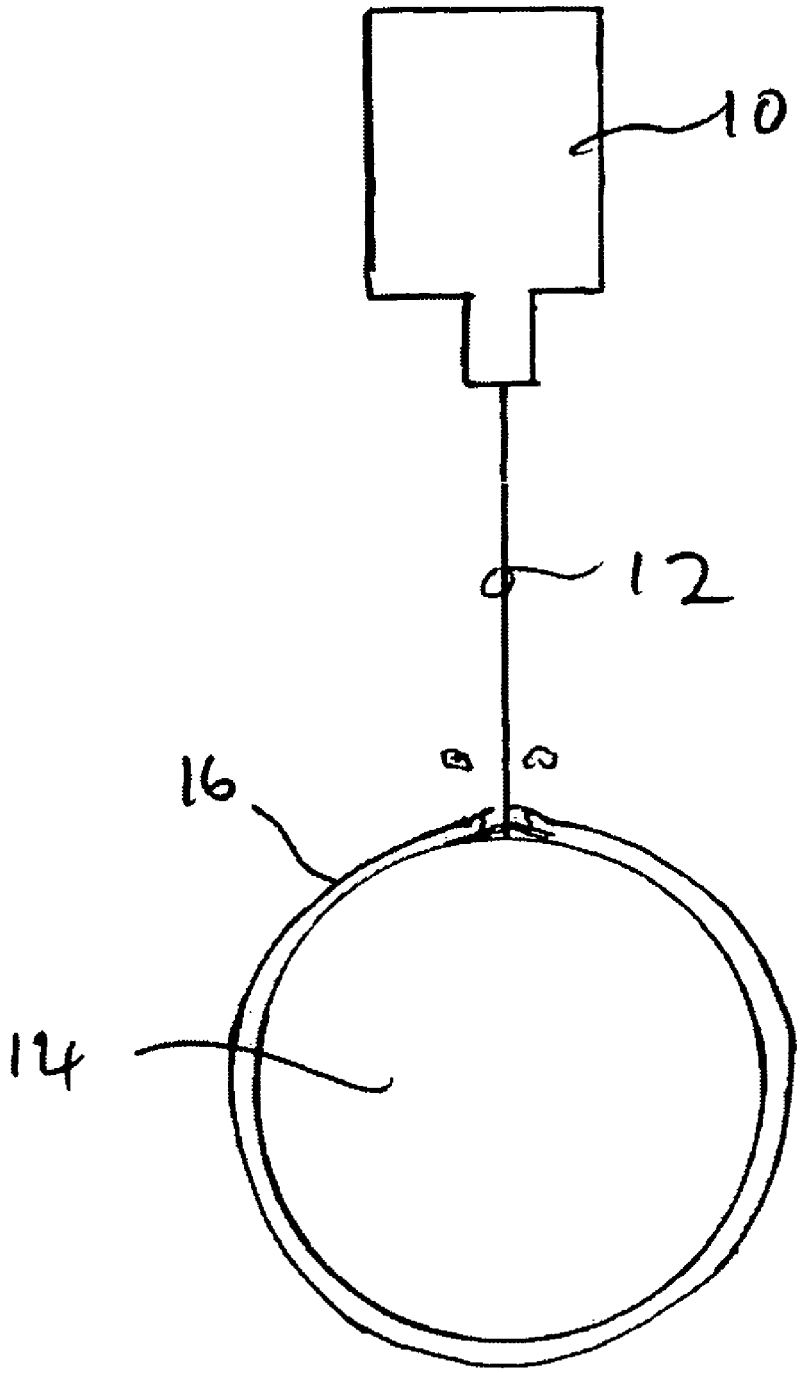

This invention relates to methods and apparatus for removing a layer or coating from a substrate and in particular, but not exclusively, to laser removal of the insulating coating or "enamel" from a conductor as a preliminary step in making an electrical connection by e.g. spot welding, soldering, crimping etc.

In one aspect this invention provides a method of treating a substrate having a layer or coating of material thereon, at least partially to remove said layer or coating, said method comprising the steps of:— directing a pulsed beam of laser radiation at said substrate to cause an interaction at or adjacent the interface between said layer or coating and said substrate, leading to local separation of said layer or coating.

Existing forms of laser wire stripper operate by vaporising the insulation from the outside in whereas in the preferred embodiments of this invention the removal is effected by creating an interaction effect at the interface between the substrate and the layer or coating to create a shockwave or the like which causes local separation, rather than relying on a vaporisation technique.

Preferably the coating or layer is substantially transparent to said laser radiation at its operating wavelength. The laser radiation may typically be of wavelength between, say, 200 nm to 12 μm and may be conveniently generated by an NdYag laser. The laser is preferably a Q-switched laser generating short pulses of typical pulse length between 1 nanosecond and 300 nanoseconds or higher. The pulse repetition rate of the laser is typically between 1 kHz and 30 kHz or higher.

In a particular preferred embodiment, the layer or coating includes a dielectric material such as a polyimide or plastics material. The substrate may typically be a conductor such as copper or copper-based material.

Preferably, said pulsed radiation beam is effective also to etch or clean the surface of the substrate adjacent the interface. This is particularly useful to remove e.g. metal oxides to leave a bare surface particularly suitable for further processing.

Preferably, during treatment, the pulsed beam of laser radiation is moved relative to the substrate in a scan direction (or vice versa) and at least one of the following parameters is controlled to cause removal of a moving swath of said layer or coating:— scan rate peak power of the laser pulse repetition rate of the laser spot size.

Preferably, said pulsed beam of radiation is scanned over a selected region of said substrate in a first scanning stage to effect initial removal of said layer or coating, and is then scanned over said region in a second scanning stage to effect cleaning of residual debris.

In another aspect, there is provided apparatus for treating a substrate having a layer or coating of material thereon, at least partially to remove said layer or coating, said apparatus comprising:— means for directing a pulsed beam of laser radiation at said substrate to cause an interaction at or adjacent the interface between said layer or coating and said substrate, leading to local separation of said layer or coating.

Whilst the invention has been described above, it extends to any inventive combination of the features set out above or in the following description.

The invention may be performed in various ways and for a better understanding thereof specific non-limiting examples will now be given, reference being made to the accompanying drawing, in which:—

FIG. 1 is a schematic view of a laser wire stripper in accordance with this invention.

In the FIGURE is shown a laser 10 which directs a pulsed beam 12 of laser radiation towards a copper wire 14 having a coating 16 of polyimide material, to create an interface effect at the interface between the coating 16 and the wire 12 to cause the coating to fragment and to be lifted off by a shockwave effect.

EXAMPLE 1

A copper wire enamelled with polyester (imide) and with/without polyamide-imide top coat and with/without a bonding overcoat, is treated as set out below to remove the enamelling. An NdYag laser of wavelength 1064 nm is used having a constant average power rating of 60 W, and 85 kW peak and a spot size of about 20 μm. The spot size generates about 200 μm diameter ablated area. The laser is Q-switched to provide a pulsed beam of pulses of between about 100 nanoseconds and 200 nanoseconds, which is scanned across the area to be stripped. The pulse repetition rate in this example is 3 kHz, the scan rate is approximately 1500 mm/sec and the peak power is of the order of 85 kW with a spot size of 20 μm. A typical pulse length of the laser is between 100 nanoseconds and 200 nanoseconds.

At this wavelength the enamel is substantially transparent to the laser radiation and the metal is highly reflective (97%) but nevertheless absorbs some of the laser radiation. We found however that the pulse radiation generated an effect adjacent the interface between the enamel and the underlying metal similar to a shockwave which caused local separation of the enamel from the wire as opposed to removal from the outside in. By suitably controlling the pulse repetition rate, the spot size and the scan rate we were able to remove large amounts of enamel to leave the metal surface bare. In addition it was noted that the laser processing had a further benefit effect in terms of etching the metal surface to remove metal oxide, thus rendering it suitable for soldering etc.

We found that, for a single scan, and with the particular equipment used in this example, the lower limit for the pulse repetition rate is in the range of 1 to 2 kHz at 1500 mm/sec scan rate which tends to give only just sufficient pulse overlap. We found the upper limit to be about 5 kHz at constant power because at higher frequencies the peak power tends to drop. Of course if the laser peak power is maintained in the preferred range of 50-100 kW then the pulse repetition rate can be further increased and in another example the laser was operated at 1 MW peak power, at a pulse repetition rate of 10 kHz, and a scan rate of 2500 mm/sec.

Also we have found that in situations where the first scan does not achieve the full effect, an acceptable result can be achieved by double scanning, e.g. the peak power may be reduced to as low as 1 to 25 kW with a pulse repetition rate in the 10 to 30 kHz range, but then the laser must scan slower, at about 100 mm/sec and the scan should be repeated.

EXAMPLE 2

A laser was set up to operate with the following parameters:—

Repetition rate: 3.5 kHz

Scan speed: 400 mm/sec

Spot size: ~50 μm

Wavelength: 1064 nm
Energy per pulse: 15 mJ
Pulse width: ~250 ns max
Peak power: ~200 KW The spot size although nominally 50 μm, also affected the surrounding area so the effective spot size in terms of the effect at the interface was about 100 μm to 200 μm. In this arrangement, the beam was scanned horizontally across the wire to be stripped and prepared, that is perpendicular to the longitudinal axis of the wire. The wire is scanned by the beam in a first pass in accordance with the above parameters, at a pitch or spacing of about 100 μm between adjacent scan lines.

The first pass removes most if not all of the coating off the wire, but may leave some debris. In a second pass the wire is scanned with the pulsed laser beam at a higher pulse rate (~8 kHz) and at a higher scan speed (~1000 mm/sec) but otherwise with the same parameters as above.

It should be noted however that in some applications the second pass may not be required, because the nature of the coating and the interface effect may mean that the coating detaches in larger flakes, leaving little or no debris.

The various parameters are set out in Table 1.

TABLE 1

| Parameter | Range | Example 1 | Example 2 |
|---|---|---|---|
| Wavelength | 200 nm to 12 μm | 1064 nm | 1064 nm |
| Pulse length | 1 ns to 300 ns | 100 ns to 200 ns | 250 ns |
| Pulse repetition rate | 1 kHz to 30 kHz | 3.5 kHz | 3.5 kHz and 8 kHz |
| Laser peak power | 50 KW-1 MW | 85 KW | 200 KW |
| Scan rate | 1-2500 mm/sec | 1500 mm/sec | 400 mm/sec and 1000 mm/sec |
| Actual spot size | 20 μm-100 μm | 20 μm | 50 μm |

The invention claimed is:

1. A method of at least partially removing a layer or coating of material from a substrate, said method comprising the steps of:

directing at said substrate a pulsed beam of laser radiation of wavelength selected so that the coating or layer is substantially transparent to said laser radiation, thereby to cause a shockwave effect at or adjacent the interface between said layer or coating and said substrate to effect local separation of said layer or coating from said substrate.

2. A method according to claim 1, wherein the coating or layer is substantially transparent to said laser radiation at its operating wavelength.

3. A method according to claim 1, wherein the laser radiation is of wavelength of between 200 nm and 12 μm.

4. A method according to claim 3, wherein said laser radiation is generated by an NdYag laser.

5. A method according to claim 1, wherein said laser radiation is generated by $CO_2$ laser.

6. A method according to claim 1, wherein said laser radiation is generated by a Q-switched laser.

7. A method according to claim 1, wherein the pulsed beam has pulses of pulse length between 1 nanosecond and 300 nanoseconds.

8. A method according to claim 1, wherein the pulse repetition rate of the pulsed beam is between 1 KHz and 30 KHz.

9. A method according to claim 1, wherein the layer or coating includes a dielectric material.

10. A method according to claim 1, wherein the substrate is a conductor of copper or copper based material.

11. A method according to claim 1, wherein the layer or coating includes at least one metal oxide.

12. A method according to claim 1, wherein said pulsed beam of radiation is effective also to etch or clean the surface of the substrate adjacent the interface.

13. A method according to claim 1, wherein the pulsed beam of laser radiation is scanned relative to the substrate in a scan direction and at least one of the following parameters is controlled to cause removal of a moving swath of said layer or coating:

scan rate
peak power of the laser
pulse repetition rate of the laser
spot size.

14. A method according to claim 13, wherein said pulsed beam of radiation is scanned over a selected region in a first scanning stage to effect initial removal of said layer or coating, and is then scanned over said region in a second scanning stage to effect cleaning of residual debris.

15. A method according to claim 1, wherein said pulsed beam of laser radiation is scanned over said substrate along successive spaced scan lines.

16. A method of at least partially removing a layer of material from a substrate, said method comprising the steps of:

providing a substrate having a layer of material disposed thereon; and subjecting the substrate with the layer of material thereon to a pulsed beam of laser radiation;

wherein parameters of the pulsed beam of laser radiation are selected so as to cause a shockwave effect at an interface between the substrate and the layer of material, thereby to achieve separation of the layer of material from the substrate.

17. The method of claim 16, wherein the pulsed beam of laser radiation is selected so as to have a wavelength that results in the layer of material being substantially transparent to the laser radiation.

18. A method according to claim 16, wherein the pulsed beam of laser radiation is scanned relative to the substrate in a scan direction, the parameters of the pulsed beam of laser radiation being controlled to cause removal of a moving swath of said layer or coating, said parameters comprising at least one of:

scan rate;
peak power of the laser;
pulse repetition rate of the laser; and
spot size.

19. A method according to claim 16, wherein said pulsed beam of laser radiation is scanned over said substrate along successive spaced scan lines.

20. A method according to claim 18, wherein said pulsed beam of radiation is scanned over a selected region in a first scanning stage to effect initial removal of said layer or coating, and is then scanned over said region in a second scanning stage to effect cleaning of residual debris.

* * * * *

UNITED STATES PATENT AND TRADEMARK OFFICE

CERTIFICATE OF CORRECTION

PATENT NO. : 7,632,420 B2
APPLICATION NO. : 10/885648
DATED : December 15, 2009
INVENTOR(S) : Thomas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 833 days.

Signed and Sealed this

Twenty-first Day of December, 2010

David J. Kappos

David J. Kappos
*Director of the United States Patent and Trademark Office*